US005687690A

United States Patent [19]

Kamiyama et al.

[11] Patent Number: 5,687,690

[45] Date of Patent: Nov. 18, 1997

[54] MOTOR VEHICLE DRIVE DEVICE

[75] Inventors: Eiichi Kamiyama, Mishima; Tatehito Ueda; Toshio Itoh, both of Susono; Hiroshi Tada, Mishima; Hideo Nagaosa; Shinichi Sano, both of Susono; Katsuhiko Aoyama, Nukata-gun; Tetsu Yamada, Toyota, all of Japan

[73] Assignee: Toyota Jidosha Kabushiki Kaisha, Aichi, Japan

[21] Appl. No.: 560,855

[22] Filed: Nov. 20, 1995

[30] Foreign Application Priority Data

Nov. 24, 1994 [JP] Japan ..... 6-289697
Nov. 25, 1994 [JP] Japan ..... 6-291288

[51] Int. Cl.[6] ..... F02B 77/00

[52] U.S. Cl. ..... 123/198 R; 123/90.31

[58] Field of Search ..... 123/41.44, 90.27, 123/90.31, 195 A, 198 R, 184.42

[56] References Cited

U.S. PATENT DOCUMENTS 5,063,897 11/1991 Okui et al. ..... 173/195 A

FOREIGN PATENT DOCUMENTS 401710 12/1990 European Pat. Off. .
412134A 1/1992 Japan .
4134107A 5/1992 Japan .
24499 10/1911 United Kingdom .

OTHER PUBLICATIONS

Patent Abstracts of Japan, vol. 16, no. 399 (M-1300), Aug. 24, 1992 & JP-A-04 134107 (Shibata Ryuji) May 8, 1992.

*Primary Examiner*—Noah P. Kamen
*Attorney, Agent, or Firm*—Kenyon & Kenyon

[57] ABSTRACT

An engine including an intermediate shaft which is driven by the crankshaft and drives the camshaft. The intermediate shaft directly drives an oil pump arranged above the transaxle and drives an alternator and compressor through a pulley connected to the intermediate shaft and a belt. The intermediate shaft is arranged shifted in the lateral direction from the plane containing the axes of the cylinders.

10 Claims, 18 Drawing Sheets

MOTOR VEHICLE DRIVE DEVICE

BACKGROUND OF THE INVENTION

1. Field of the Invention

The present invention relates to a device for driving a motor vehicle, more particularly relates to an engine.

2. Description of the Related Art

Known in the art is a drive device for a motor vehicle provided with an intermediate shaft arranged in parallel with an engine crankshaft and driven by that crankshaft, a camshaft for driving intake and exhaust valves which is driven by the intermediate shaft, and an auxiliary machine which is arranged above a trans-axle attached to a longitudinal end of the engine and is driven directly by the intermediate shaft (see Japanese Unexamined Patent Publication (Kokai) No. 4-134107). In this motor vehicle drive device, the auxiliary machine is positioned in the space formed above the trans-axle so as to make efficient use of the space formed there.

The position of the intermediate shaft, however, becomes a problem when it comes to making truly effective use of the space formed above the trans-axle. For example, when the intermediate shaft is arranged in the plane including the axes of the cylinders, since the intermediate shaft is positioned above the highest portion of the trans-axle, the intermediate shaft has to be raised higher. In this case, the position of the auxiliary machine which is directly driven by the intermediate shaft also becomes higher, so it is no longer possible to secure sufficient space for arranging other auxiliary machines above the trans-axle in addition to that auxiliary machine. While the position of the intermediate shaft is therefore an issue when ensuring effective utilization of the space above the trans-axle, no consideration has been given to the position of the intermediate shaft in the above motor vehicle drive device and accordingly there was the problem that effective use was not necessarily made of the space above the trans-axle.

SUMMARY OF THE INVENTION

An object of the present invention is to provide a motor vehicle drive device capable of effectively making use of the space existing above the trans-axle for the arrangement of auxiliary machines.

According to the present invention, there is provided an engine for use in a motor vehicle, comprising a plurality of cylinders each having at least one intake valve and at least one exhaust valve; a crankshaft; an intermediate shaft driven by the crankshaft and arranged in parallel to the crankshaft at a position which is laterally remote from a plane including axes of the cylinders; a camshaft driven by the intermediate shaft and driving at least one of the intake valve and the exhaust valve; a trans-axle attached to one of the longitudinal ends of the engine; and at least one auxiliary machine arranged above the trans-axle and driven by the intermediate shaft.

BRIEF DESCRIPTION OF THE DRAWINGS

The present invention may be more fully understood from the description of the preferred embodiments of the invention set forth below, together with the accompanying drawings, in which.

DESCRIPTION OF THE PREFERRED EMBODIMENTS

Figure 1:
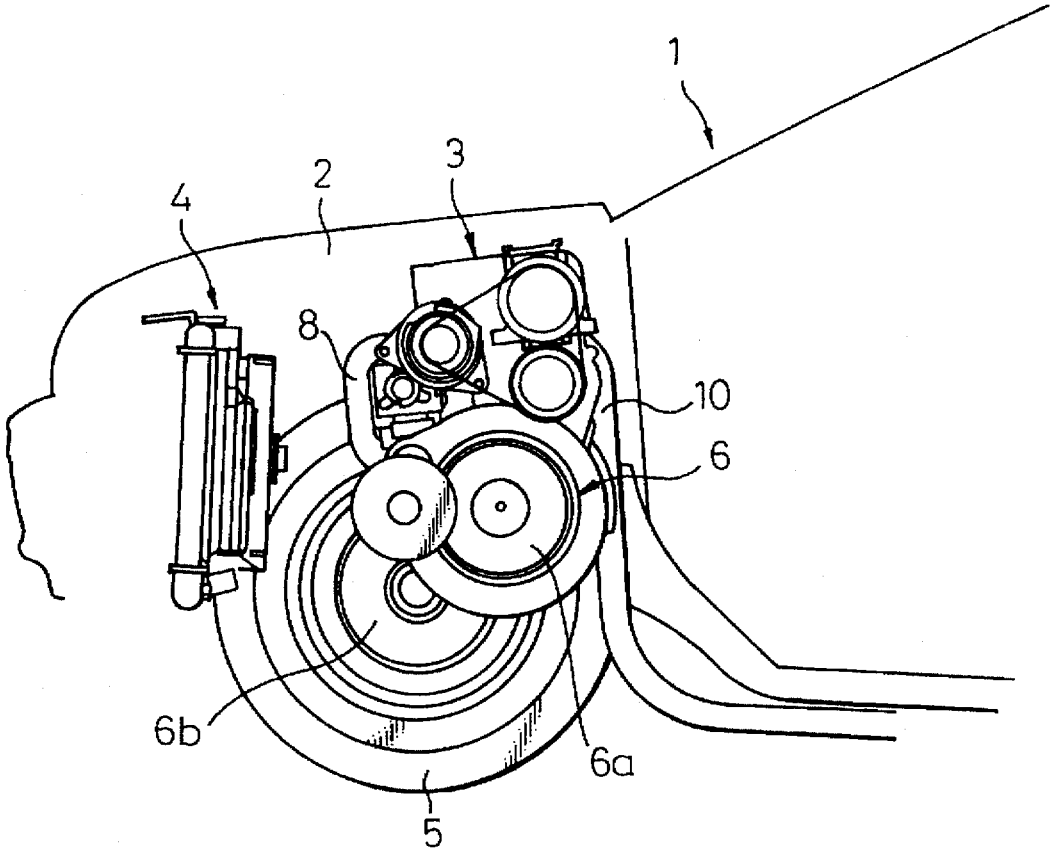
FIG. 1 is a side view schematically showing the front half of a motor vehicle.

Referring to FIG. 1, 1 is a motor vehicle, 2 is an engine compartment formed at the front of the motor vehicle in the direction of advance of the vehicle 1, 3 is an engine body arranged in the engine compartment so as to extend in the lateral direction with respect to the direction of advance of the vehicle, 4 is a radiator arranged in front of the engine body 3, and 5 is a front wheel. As shown from FIG. 1 to FIG. 3, a trans-axle 6 is attached to the end of the engine body 3. This trans-axle 6 is provided with a portion 6*a* housing a torque converter and automatic transmission and a portion 6b housing a differential gear. The output shaft 7 of the differential gear is connected to the front wheels 5.

In front of the engine body 3 are arranged intake pipes 8 extending from the engine body 3 toward the front and a common surge tank 9 connected to the intake pipes 8. Exhaust pipes 10 are arranged behind the engine body 3.

Figure 2:
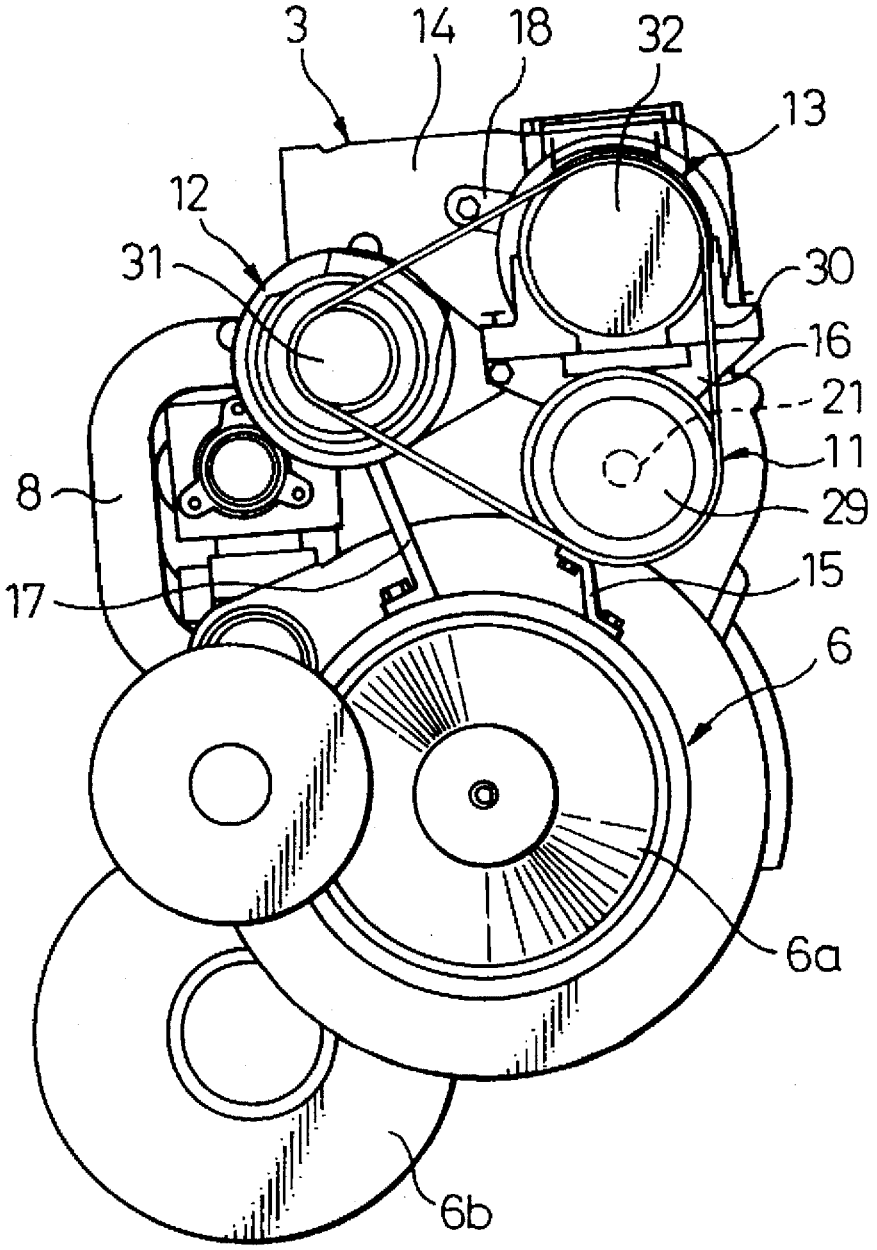
FIG. 2 is a side view of the engine as a whole.
Figure 3:
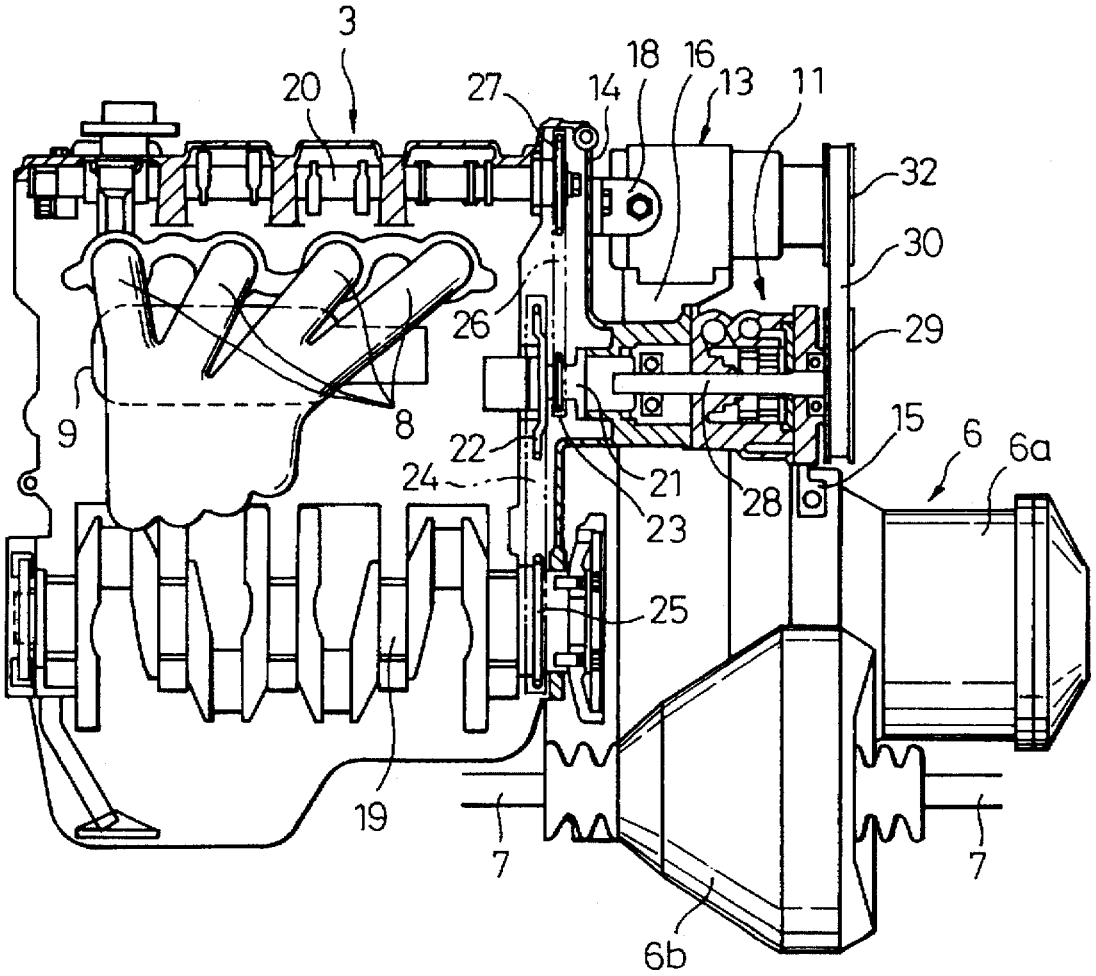
FIG. 3 is a side view of FIG. 2.

On the other hand, in the area above the trans-axle 6, in the embodiment shown from FIG. 1 to FIG. 3, three auxiliary machines, that is, a power steering oil pump 11, alternator 12, and air-conditioner compressor 13, are arranged in the area above the trans-axle portion 6a. The end of the engine body 3 on the trans-axle 6 side is covered by a chain cover 14 fastened to the engine body 3. One end of each of the auxiliary machines 11, 12, and 13 is supported by this chain cover 14. That is, one end of the oil pump 11 is supported by the chain cover 14, while the other end of the oil pump 11 is supported by the trans-axle 6 through a stay 15. Further, one end of the alternator 12 is supported by a bracket 16 formed integrally with the chain cover 14, while the other end of the alternator is supported by the trans-axle through a stay 17. The compressor 13 is supported on the bracket 16. Further, the compressor 13 is supported by the chain cover 14 through a stay 18.

As will be clear from FIG. 3, the trans-axle 6 is supported in a cantilever fashion by the engine body 3. Accordingly, there is the danger that the trans-axle 6 will vibrate with respect to the engine body 3 when the motor vehicle is moving. In the embodiment according to the present invention, however, the intermediate portion of the trans-axle 6 in the longitudinal direction is connected on the one hand to the chain cover 14 through the stay 15 and the oil pump 11 and on the other hand to the chain cover 14 through the stay 17 and the alternator 12. That is, in the embodiment according to the present invention, the oil pump 11 and the alternator 12 perform the function of stays for connecting the intermediate portion of the trans-axle 6 to the chain cover 14. In this way, through the provision of components performing stay functions, it is possible to suppress vibration of the trans-axle 6.

Between the crankshaft 19 disposed at the lower portion of the engine body 3 and the camshaft 20 for driving the intake and exhaust valves disposed at the upper portion of the engine body 3 is arranged an intermediate shaft 21 extending in parallel with the crankshaft 19 and the camshaft 20. On this intermediate shaft 21 are attached a large diameter sprocket 22 and a small diameter sprocket 23. The large diameter sprocket 22 is connected to a sprocket 25 attached to the end of the crankshaft 19 through a chain 24, while the small diameter sprocket 23 is connected to a sprocket 27 attached to the end of the camshaft 20 through the chain 26. The rotational force of the crankshaft 19 is conveyed to the intermediate shaft 21 through the chain 24, while the rotational force of the intermediate shaft 21 is conveyed to the camshaft 20 through the chain 26. Accordingly, the camshaft 20 is driven by the crankshaft 19 through the intermediate shaft 21.

One end of the intermediate shaft 21 is connected to the shaft 28 of the oil pump 11. A pulley 29 is attached to the outer end of the shaft 28 of the oil pump 11. The pulley 29 is connected to a pulley 31 of the alternator 12 and a pulley 32 of the compressor 13 through a belt or chain 30. The rotational power of the oil pump 11 is conveyed to the alternator 12 and the compressor 13 through the belt or chain 30, so the oil pump 11, the alternator 12, and the compressor 13 are driven by the crankshaft 19.

Figure 4:
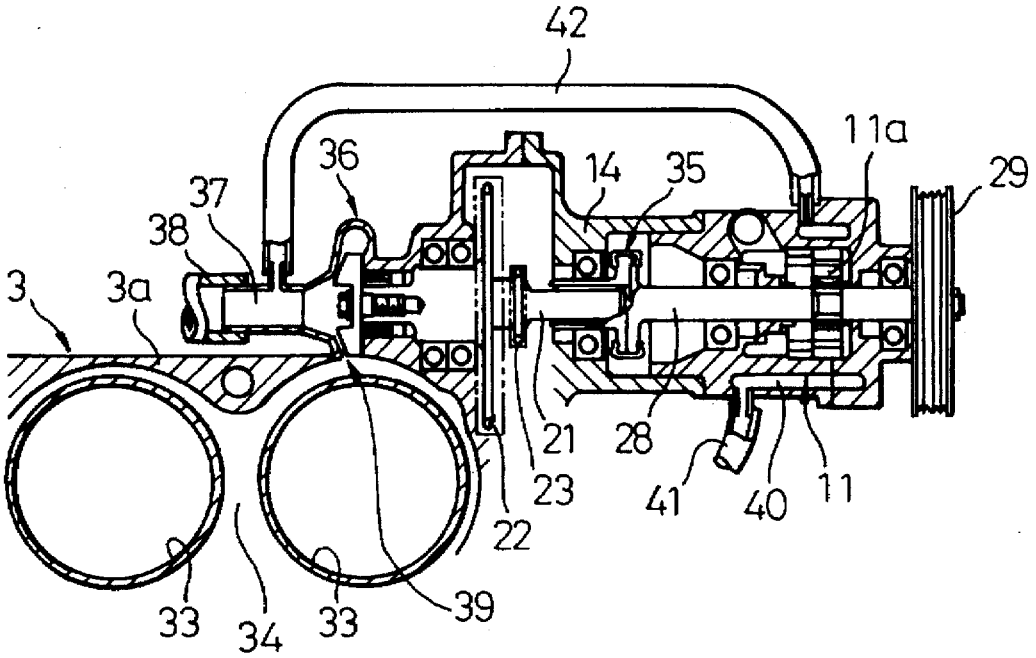
FIG. 4 is a plane cross-sectional view of the area around the intermediate shaft.

FIG. 4 shows another embodiment of the intermediate shaft 21. Note that in FIG. 4, 33 shows a cylinder bore, while 34 shows a water jacket formed around the cylinder bore 33. In this embodiment, one end of the intermediate shaft 21 is connected through the coupling 35 to the shaft 28 of the oil pump 11, while the other end of the intermediate shaft 21 is connected to one of the auxiliary machines, that is, the water pump 36. Accordingly, in this embodiment, the two ends of the intermediate shaft 21 are connected to the individual auxiliary machines, that is, the oil pump 11 and the water pump 36. The cooling water inlet 37 of the water pump 36 is connected through a hose 38 to the radiator 4 (FIG. 1), while the cooling water outlet of the water pump 36 opens inside the water jacket 34 at the side wall of the cylinder block 3a of the engine body 3. Accordingly, the intermediate shaft 21 is arranged shifted in the lateral direction toward the outside of the cylinder block 3a with respect to the plane including the axes of the cylinders.

In this embodiment, further, as shown in FIG. 4, a cooling water passage 40 is formed so as to surround the rotor 11a of the oil pump 11. The cooling water passing through the radiator 4 (FIG. 1) is supplied to the inside of the cooling water passage 40 through the hose 41. The cooling water supplied inside the cooling water passage 40 passes inside the oil pump 11, then is discharged into the cooling water inlet 37 through the hose 42.

When the power steering oil pump 11 is being operated at its maximum load, the temperature of the oil in the oil pump 11 becomes considerably higher than the temperature of the cooling water flowing from the radiator 4. Accordingly, as shown in FIG. 4, by sending the cooling water from the radiator 4 into the cooling water passage 40 in the oil pump 11, it is possible to effectively cool the oil pump 11. On the other hand, when the temperature of the outside air is extremely low, the temperature of the oil in the oil pump 11 sometimes becomes lower than the temperature of the cooling water flowing out from the radiator 4. In such a case, it is possible to warm the oil pump 11 to a suitable temperature by sending the cooling water flowing out from the radiator 4 into the oil pump 11.

Figure 5:
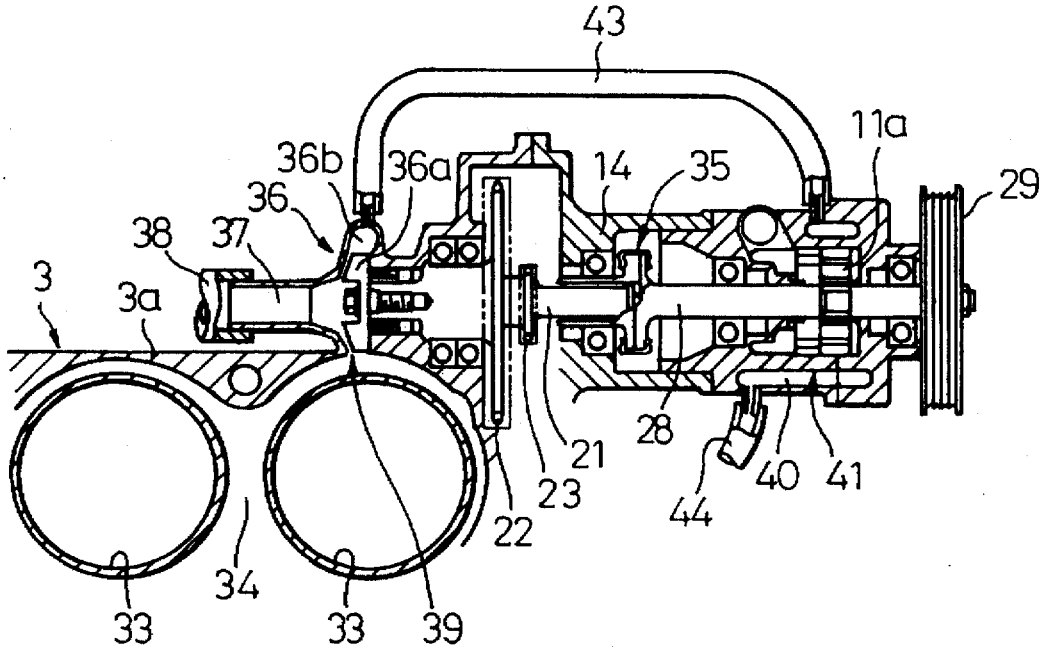
FIG. 5 is a plane cross-sectional view of the area around the intermediate shaft showing another embodiment of the setup of FIG. 4.

FIG. 5 shows still another embodiment. In this embodiment, a cooling water outflow chamber 36b formed around an impeller 36a of a water pump 36 is connected to a cooling water passage 40 inside the oil pump 11 through a hose 43. Accordingly, in this embodiment, part of the cooling water discharged from the water pump 36 is supplied into the cooling water passage 40 through the hose 43. The cooling water supplied into the cooling water passage 40 is discharged through the hose 44 into the cooling water passage in the cylinder head. In this embodiment too, effects similar to those of the embodiment shown in FIG. 4 are obtained.

Figure 6:
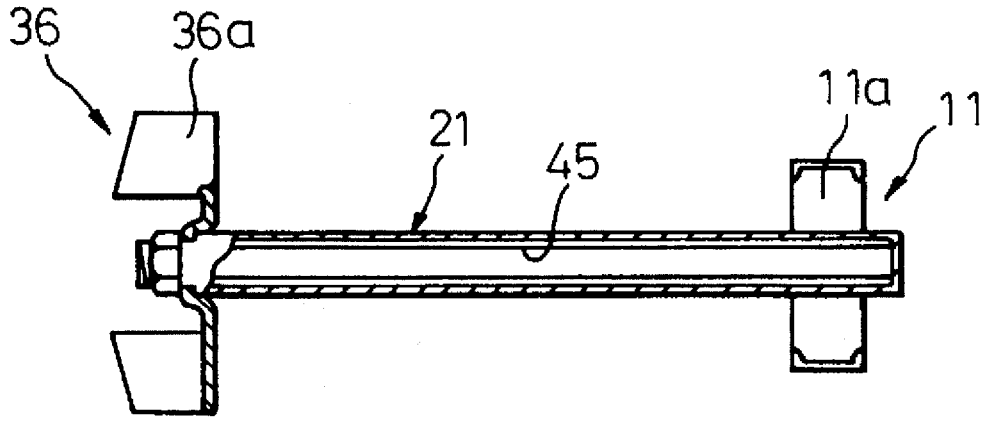
FIG. 6 is a plane cross-sectional view of the area around the intermediate shaft showing still another embodiment of the setup of FIG. 4.
Figure 7:
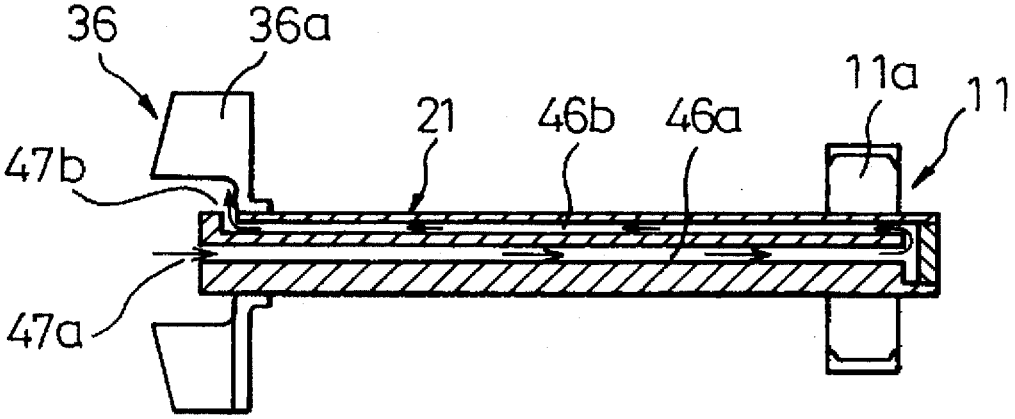
FIG. 7 is a plane cross-sectional view of the area around the intermediate shaft showing yet another embodiment of the setup of FIG. 4.

FIGS. 6 and 7 show still other embodiments of the invention. Note that in FIGS. 6 and 7, only the rotor 11a of the oil pump 11 and only the impeller 36a of the water pump 36 are shown. The rest of the parts are omitted. As will be understood from FIGS. 6 and 7, in these embodiments, the intermediate shaft 21 is used as the shaft of the oil pump 11 and the water pump 36. That is, in these embodiments, the rotor 11a of the oil pump 11 and the impeller 36a of the water pump 36 are supported by the intermediate shaft 21.

In the embodiment shown in FIG. 6, the intermediate shaft 21 is comprised of a hollow cylindrical heat pipe. Accordingly, a web 45 formed with a plurality of grooves extending in the axial direction is arranged on the inner circumference of the intermediate shaft 21. When the temperature of the oil in the oil pump 11 is higher than the temperature of the cooling water in the water pump 36, the heat flows inside the intermediate shaft 21 from the oil pump 11 side to the water pump 36 side. When the temperature of the cooling water inside the water pump 36 is higher than the temperature of the oil in the oil pump 11, the heat flows inside the intermediate shaft 21 from the water pump 36 side to the oil pump 11 side. In this case, the temperature of the cooling water in the water pump 36 becomes fairly constant and therefore the temperature of the oil in the oil pump 11 is controlled to approach the substantially constant cooling water temperature.

On the other hand, in the embodiment shown in FIG. 7, inside the intermediate shaft 21 are formed a cooling water inflow passage 46*a* extending along the center axis of the intermediate shaft 21 and a cooling water outflow passage 46*b* extending along the axial direction at the outer circumferential portion of the intermediate shaft 21. These cooling water inflow passage 46*a* and cooling water outflow passage 46*b* are communicated with each other at the rotor 11*a* side. Further, the inlet 47*a* of the cooling water inflow passage 46*a* opens inside the water pump 36 at the center axis of the intermediate shaft 21, while the outlet 47*b* of the cooling water outflow passage 46*b* opens inside the water pump 36 at the outer circumference of the intermediate shaft 21. When the intermediate shaft 21 turns, the centrifugal force causes the cooling water to flow in the cooling water inflow passage 46*a* and the cooling water outflow passage 46*b* in the arrow direction and thereby heat is exchanged between the oil pump 11 and the water pump 36. Accordingly, in this embodiment, effects similar to those of the embodiment shown in FIG. 6 are obtained.

Figure 8A:
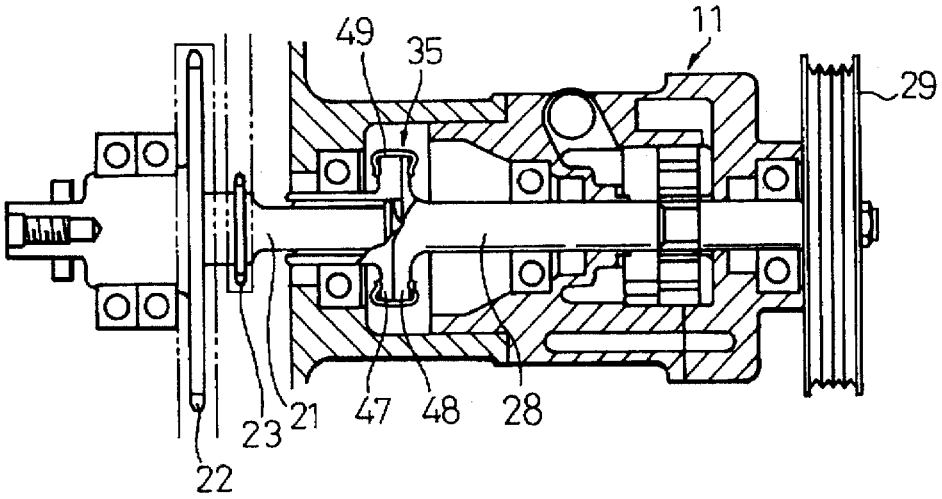
FIGS. 8A and 8B are partially enlarged cross-sectional views of the setup of FIG. 4.
Figure 8B:
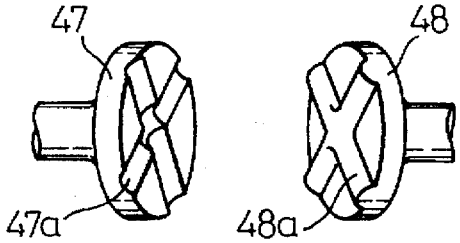

FIG. 8A is an enlarged view of FIG. 4. Referring to FIG. 8A, as explained above, the intermediate shaft 21 and the shaft 28 of the oil pump 11 are connected to each other through a coupling 35. The coupling 35 is comprised of a large diameter face cam 47 connected to the end of the intermediate shaft 21, a large diameter face cam 48 integrally formed with the end of the shaft 28 of the oil pump 11, and a spring member 49 pressing together the cam faces of the pair of face cams 47 and 48. As shown in FIG. 8B, a cross-shaped depression 47*a* is formed in the cam face of the face cam 47, while a cross-shaped projection 48*a* which fits with the cross-shaped depression 47*a* is formed on the cam face of the face cam 48.

Normally, the pair of face cams 47 and 48 are pressed strongly against each other by the spring member 49 in a state with the cross-shaped projection 48*a* fitted in the cross-shaped depression 47*a*. If for example an abnormality occurs in the oil pump 11 and the oil pump 11 locks, the cross-shaped projection 48*a* will pull out from the cross-shaped depression 47*a* and as a result the intermediate shaft 21 will rotate relative to the shaft 28. Accordingly, even if one of the auxiliary machines, that is, the oil pump 11, locks, the engine will continue operating without stopping. Note that when for some reason or another the rotational load on the oil pump 11 becomes abnormally high and the intermediate shaft 21 starts to rotate relative to the shaft 28 and then the rotational load of the oil pump 11 falls, the face cams 47 and 48 will once again join and the shaft 28 will rotate together with the intermediate shaft 21. Further, in this embodiment, if the face cams 47 and 48 rotate relative to each other, they will generate an abnormal sound so it is possible to determine that the oil pump 11 is operating abnormally when such a sound is produced.

In this way, the coupling 35 is comprised of a torque limiting means which limits the conveyance of a torque from the intermediate shaft 21 to the shaft 28. As such a torque limiting means, consideration may be given to the various forms shown from FIG. 9 to FIG. 12 in addition to that shown in FIGS. 8A and 8B.

Figure 9:
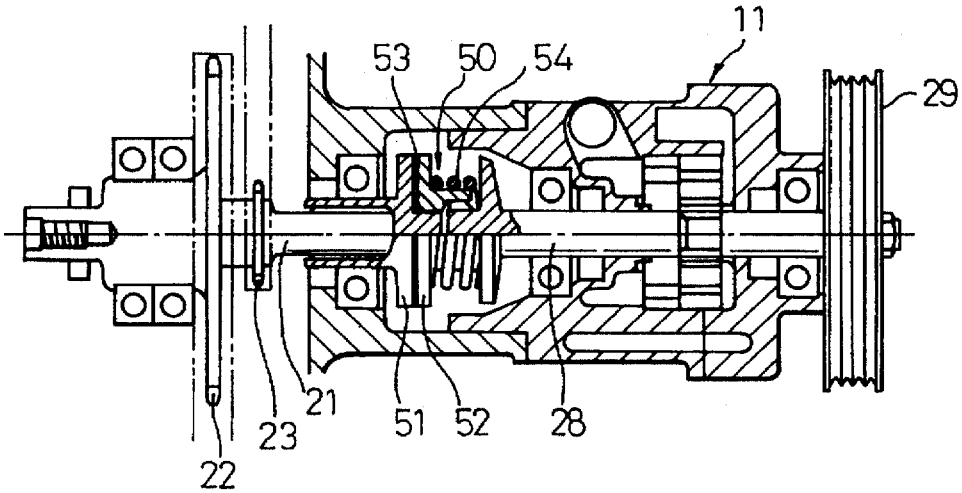
FIG. 9 is a plane cross-sectional view of another embodiment of the setup of FIGS. 8A and 8B.

That is, the torque limiting means 50 shown in FIG. 9 is comprised of a large diameter disk 51 connected to the intermediate shaft 21, a clutch plate 52 spline-connected to the shaft 28, and a compression spring 54 for pressing the clutch plate 52 on the disk 51 through a friction member 54. When for example the oil pump 11 locks, the clutch plate 52 and the disk 51 rotate relative to each other.

Figure 10:
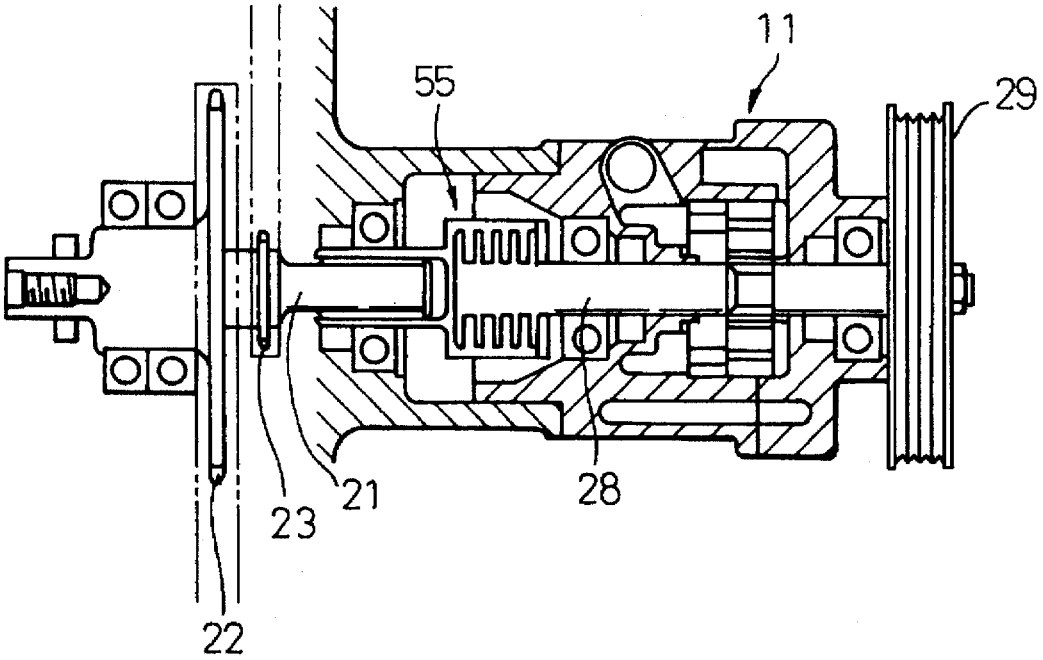
FIG. 10 is a plane cross-sectional view of still another embodiment of the setup of FIGS. 8A and 8B.
Figure 11:
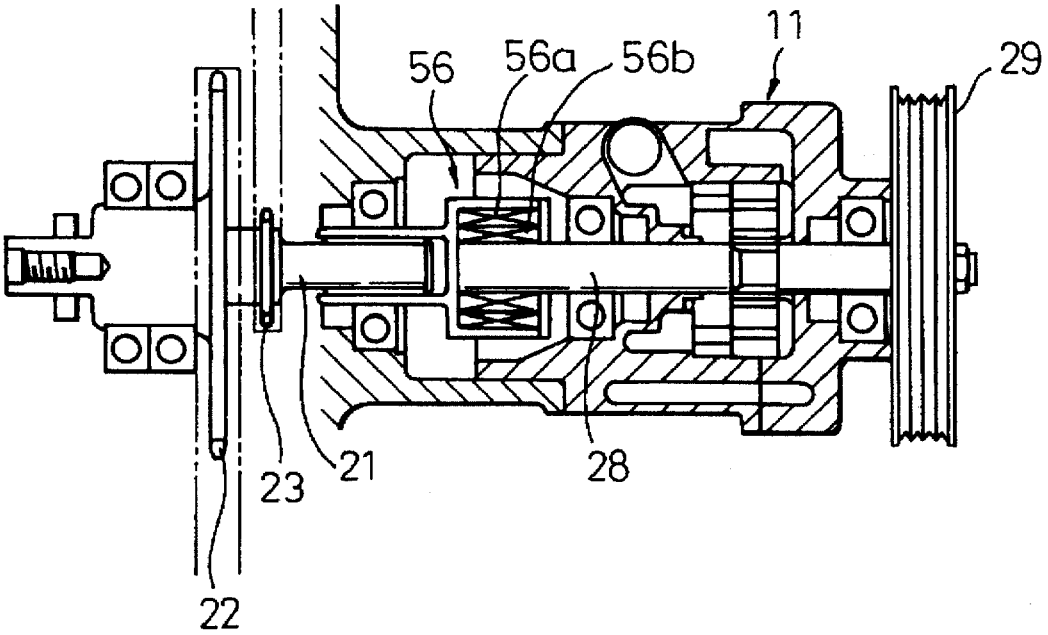
FIG. 11 is a plane cross-sectional view of yet another embodiment of the setup of FIGS. 8A and 8B.
Figure 12:
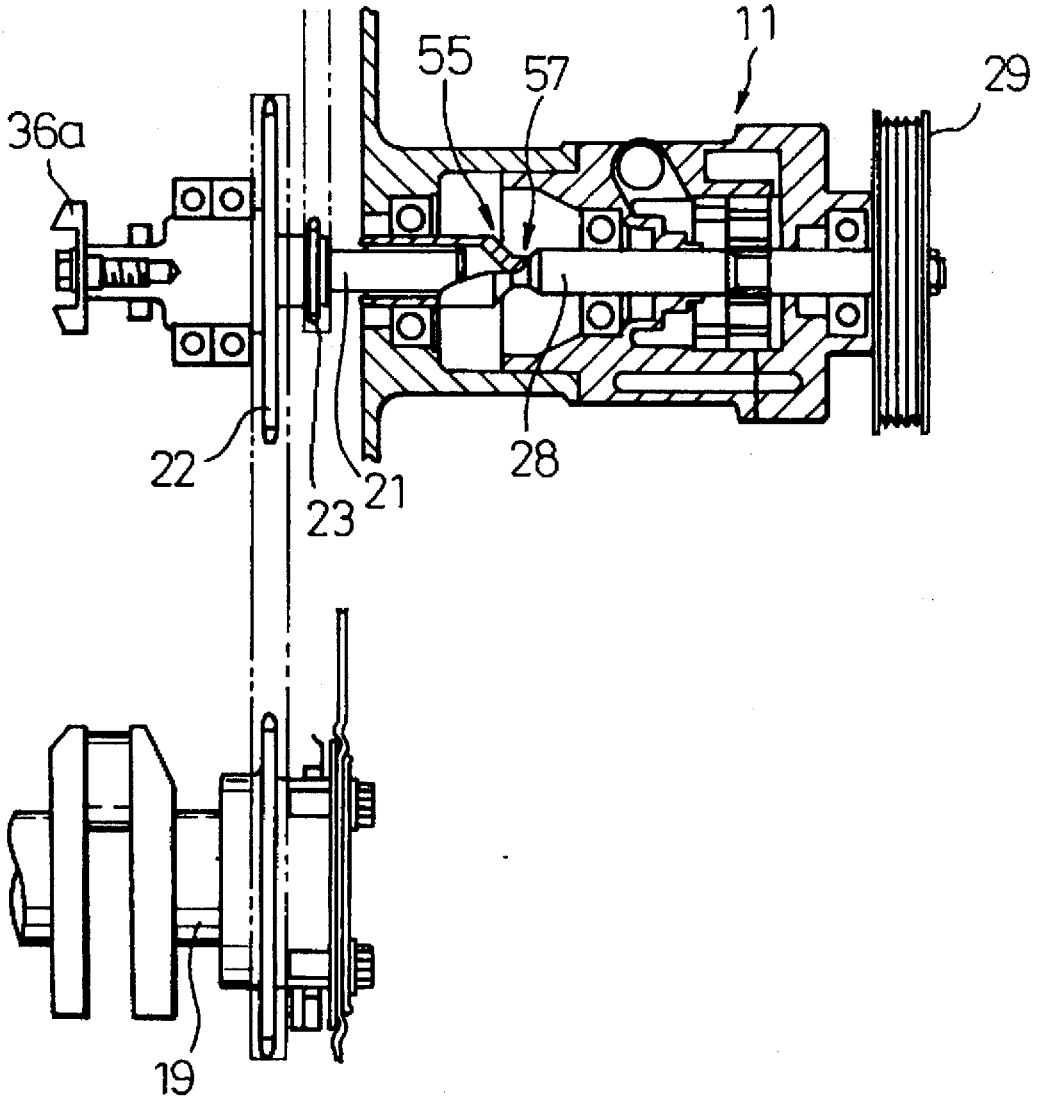
FIG. 12 is a plane cross-sectional view of yet another embodiment of the setup of FIGS. 8A and 8B.

The torque limiting means 55 shown in FIG. 10 is comprised of a viscous coupling using the viscosity of silicone oil, while the torque limiting means 56 shown in FIG. 11 is comprised of a magnetic coupling using the force of attraction between a pair of cylindrical permanent magnets arranged coaxially. Further the torque limiting means 55 shown in FIG. 12 is comprised of a small diameter portion 57 formed on the shaft 28 of the oil pump 11. In this embodiment, when for example the oil pump 11 locks, the small diameter portion 57 breaks and therefore the engine can continue operating without stopping.

Figure 13:
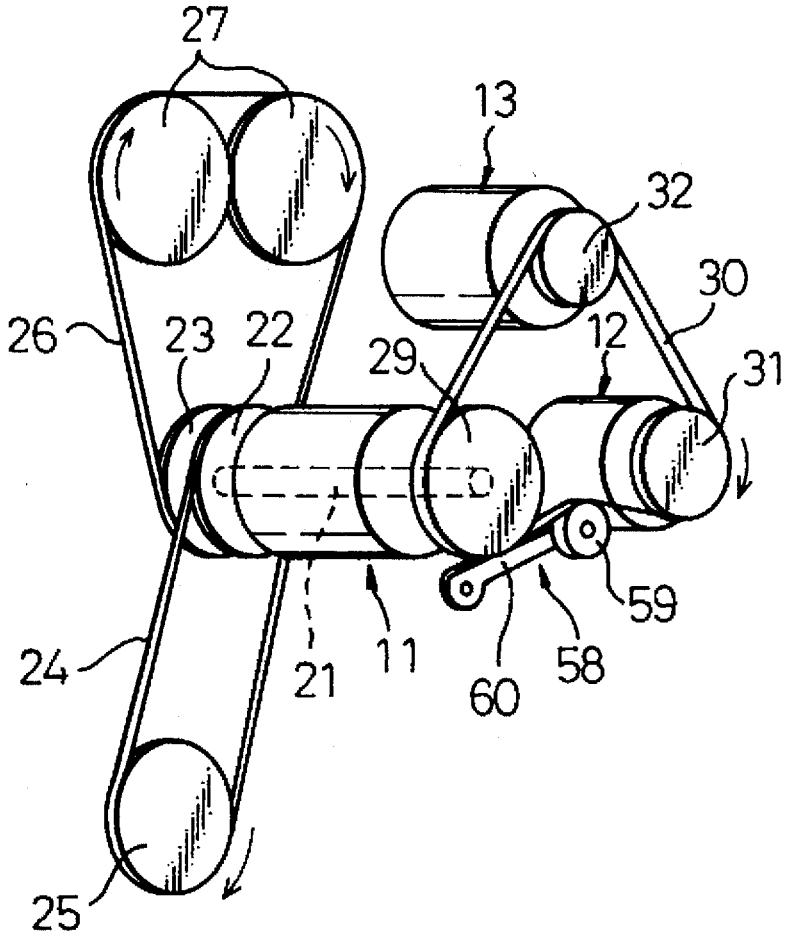
FIG. 13 is a perspective view of still another embodiment of the setup of FIGS. 8A and 8B.

FIG. 13 shows a somewhat modified torque limiting means 58. In this embodiment too, the intermediate shaft 21 is driven by the sprocket 25 of the crankshaft 19 which turns in the arrow direction, the oil pump 11 and the pulley 29 are driven by the intermediate shaft 21, and the alternator 12 and the compressor 13 are driven in the arrow direction by the pulley 29. At the chain or belt 30 portion from the adjoining auxiliary machine to the pulley 29 of the oil pump 11, in the embodiment shown in FIG. 13, is provided an idle roller 59 for pressing in the lateral direction the chain or belt portion 30 at the portion positioned between the pulley 31 of the alternator 12 and the pulley 29 of the oil pump 11. This idle roller 59 is supported by the trans-axle 6 (FIG. 3) through a support arm 60. This support arm 60 is formed so as to deform or break when more than a certain pressing force acts on the idle roller 59.

If the alternator 12 or the compressor 13 breaks down and the alternator 12 or compressor 13 locks, a large tensile force will act on the chain or belt 30 portion positioned between the pulley 31 of the alternator 31 and the pulley 29 of the oil pump 11. As a result, the chain or belt 30 portion will become straight, so a large pressing force will act on the idle roller 59 and therefore the support arm 60 of the idle roller 59 will deform or break. If the support arm 60 deforms or breaks, the chain or belt 30 will become loose, so the pulley 29 will no longer drive the remaining pulleys 31 and 32 and therefore the oil pump 11 will continue to be driven by the engine without the engine stopping.

Figure 14A:
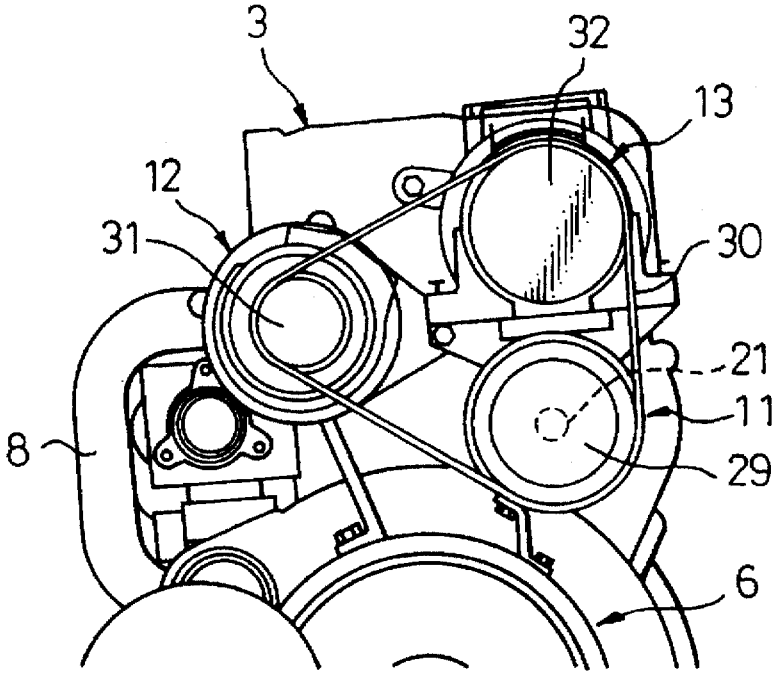
FIGS. 14A and 14B are views for explaining the arrangement of auxiliary machines.

FIG. 14A shows a portion of FIG. 2. As explained above, in this embodiment of the present invention, the auxiliary machines, that is, the oil pump 11, the alternator 12, and the compressor 13, are positioned in the area above the trans-axle 6. In a motor vehicle, the energy of a collision is designed to be absorbed by deformation of the vehicle body. In this case, the longer the deformable length of the vehicle body in the direction of advance, the greater the amount of energy of collision which can be absorbed. In motor vehicles with the engine body 3 arranged in an engine compartment in the front of the vehicle, the deformable length of the vehicle in the direction of advance becomes the length of the vehicle body in the direction of advance positioned in front of the engine body 3. Accordingly, to increase the amount of energy of collision which can be absorbed, it is necessary to increase as much as possible the length of the vehicle body in the direction of advance positioned in front of the engine body 3. Toward this end, it is necessary to make the width of the engine body 3 in the direction of advance of the vehicle, that is, the lateral width, as narrow as possible. Accordingly, in this embodiment of the present invention, the auxiliary machines such as the oil pump 11, the alternator 12, and the compressor 13 are arranged in the space above the trans-axle 6 as mentioned above.

Further, the intake pipes 8 and the surge tank 9 (FIG. 3) are weaker in rigidity than the exhaust pipes 10 and easily deform. Accordingly, even if the intake pipes 8 and the surge tank 9 are arranged in front of the engine body 3, the intake pipes 8 and surge tank 9 will not be that great an obstacle to deformation of the vehicle body and therefore can serve to increase the action of the vehicle body in absorbing the energy of collision.

Further, to reduce the lateral width of the engine body 3, it is preferable to dispose the auxiliary machines superposed in the vertical direction. Therefore, in this embodiment of the present invention, two auxiliary machines, that is, the oil pump 11 and the compressor 13, as shown in FIG. 14A, are arranged a certain distance apart from each other in the vertical direction. If two auxiliary machines 11 and 13 are arranged superposed in the vertical direction in this way, then space for arranging another auxiliary machine, that is, the alternator 12, can be provided in the space above the trans-axle 6. That is, seen from another viewpoint, in an internal combustion engine using an intermediate shaft 21, arranging the intermediate shaft 21 shifted in the lateral direction from the plane containing the center axes of the cylinders makes it possible to arrange a large number of auxiliary machines in the space above the trans-axle 6. Accordingly, another major feature of the invention is that the intermediate shaft 21 is arranged shifted in the lateral direction with respect to the plane containing the center axes of the cylinders so as to reduce the lateral width of the engine body 3.

Figure 15A:
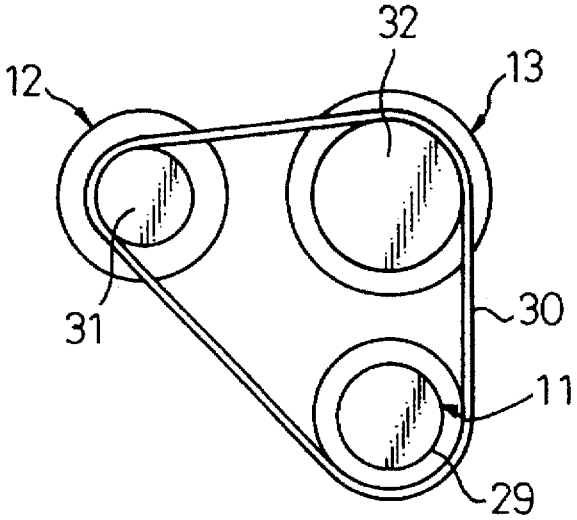
FIGS. 15A and 15B are views for explaining an undesirable arrangement of auxiliary machines.
Figure 15B:
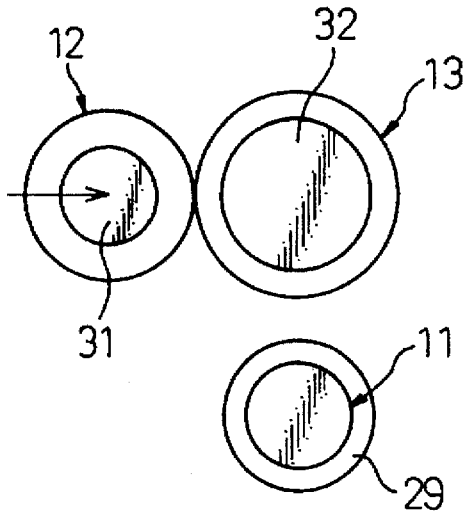

Another major feature is that, as shown in FIG. 14A, the auxiliary machine 12 arranged ahead of the two auxiliary machines 11 in the direction of advance of the vehicle is arranged at a height between the auxiliary machines 11 and 13, that is, the center axes of the auxiliary machines 11, 12, and 13 are offset from each other in the vertical direction. That is, when the motor vehicle is involved in a collision, even with an auxiliary machine 12 arranged at the front, an impact force will be generated which moves the auxiliary machine 12 rearward. At this time, to ensure that the energy of the collision be effectively absorbed by the vehicle body, it is necessary to enable the auxiliary machine 12 to move easily to the rear. For example, as shown in FIG. 15A, if the auxiliary machine 12 and the auxiliary machine 13 are arranged so that their center axes are within substantially the same horizontal plane, then when the motor vehicle is involved in a collision, the auxiliary machine 12 will move rearward and strike the auxiliary machine 13 from the lateral direction as shown by the arrow in FIG. 15B. In this case, the movement of the auxiliary machine 12 would be obstructed by the auxiliary machine 13.

Figure 14B:
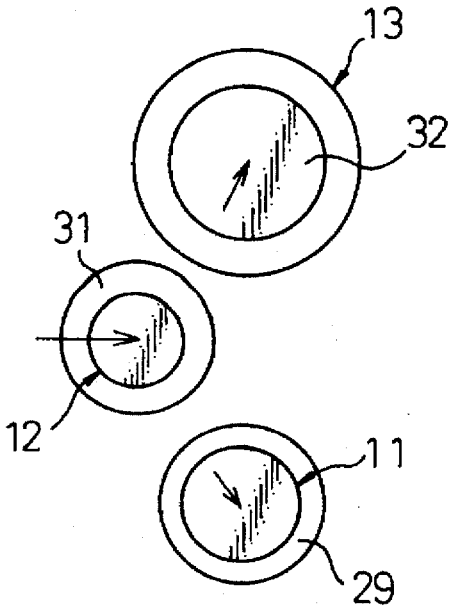
Figure 16:
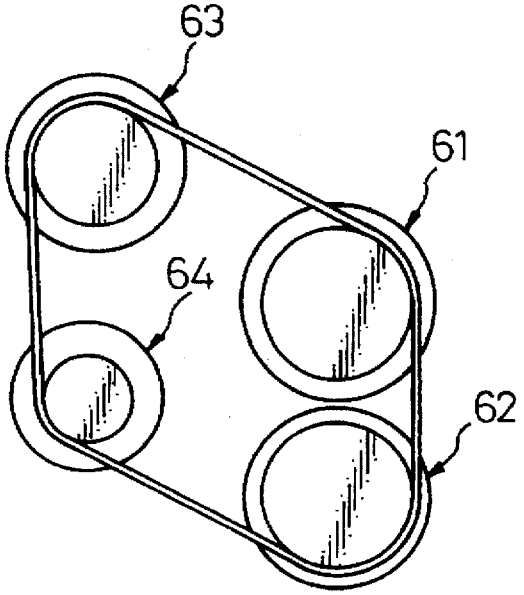
FIG. 16 is a view for explaining a desirable arrangement of auxiliary machines.

As opposed to this, if the auxiliary machines 11, 12, and 13 are arranged as shown in FIG. 14A, then when the vehicle is involved in a collision, when the auxiliary machine 12 moves rearward as shown by the arrow in FIG. 14B, the auxiliary machine 12 will enter between the auxiliary machine 11 and auxiliary machine 13. At this time, the effect will be like driving a wedge between the two auxiliary machines 11 and 13, so the auxiliary machines 11 and 13 will respectively be moved upward and downward. Accordingly, the amount of rearward movement of the auxiliary machine 12 at the time of a collision will become greater and therefore the amount of energy of the collision which the vehicle body can absorb will be increased. A similar idea can be applied to the four auxiliary machines 61, 62, 63 and 64 as shown in FIG. 16. That is, when there are the four auxiliary machines 61, 62, 63, and 64 as shown in FIG. 16, it is preferable to arrange the auxiliary machines 61, 62, 63, and 64 so that their center axes are offset from each other in the vertical direction.

Figure 17A:
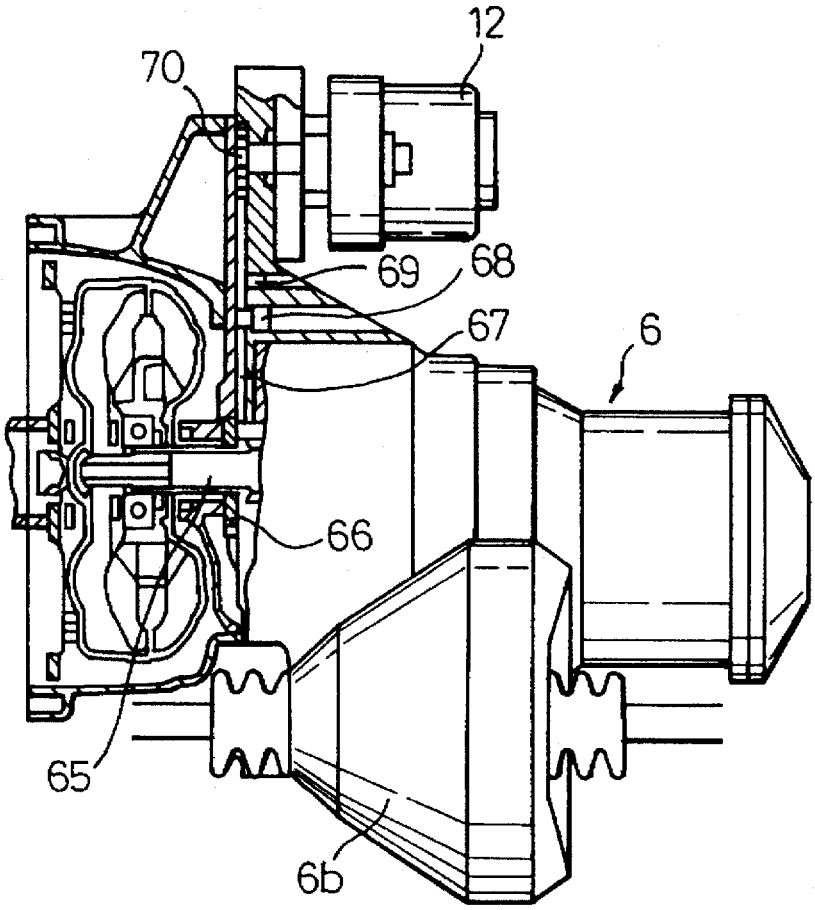
FIGS. 17A and 17B are partial cross-sectional side views of a trans-axle showing another embodiment of the invention.
Figure 17B:
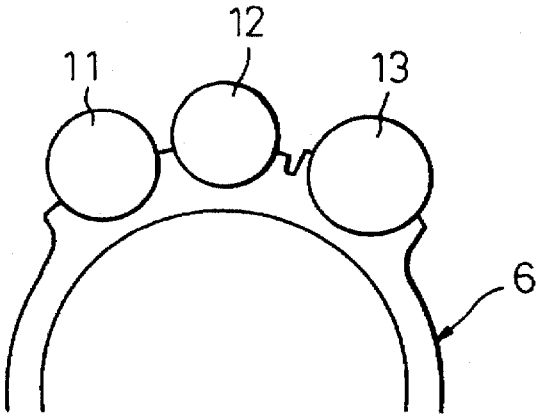
Figure 18A:
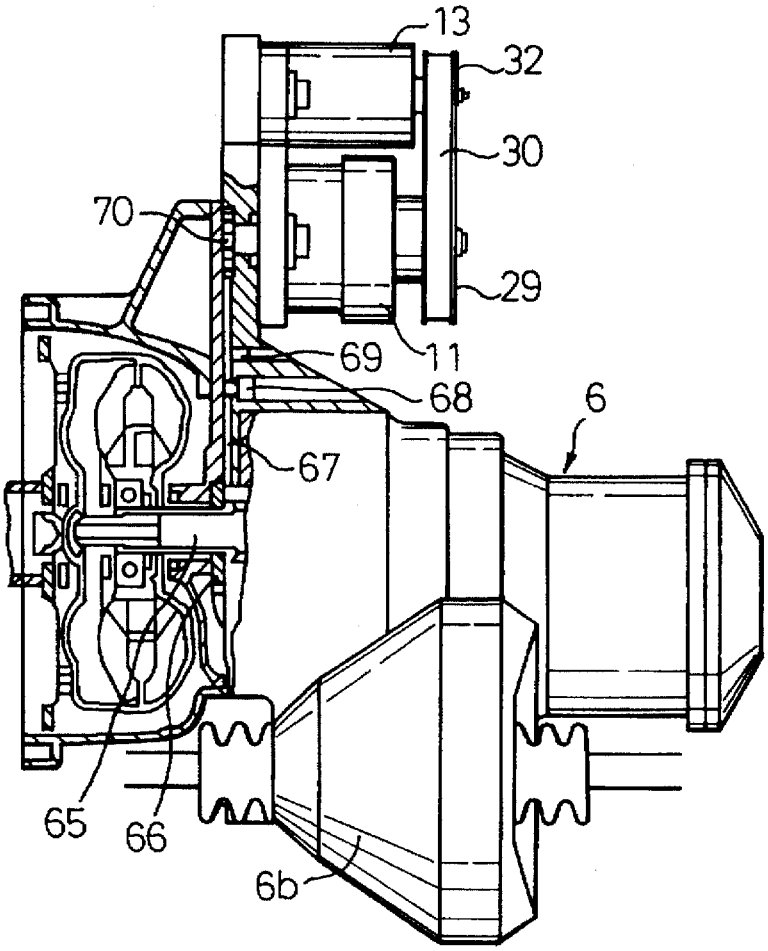
FIGS. 18A and 18B are partial cross-sectional side views of another embodiment of the setup of FIGS. 17A and 17B.
Figure 18B:
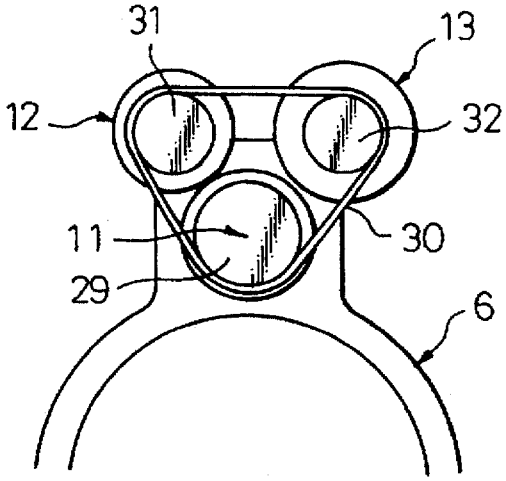
Figure 19A:
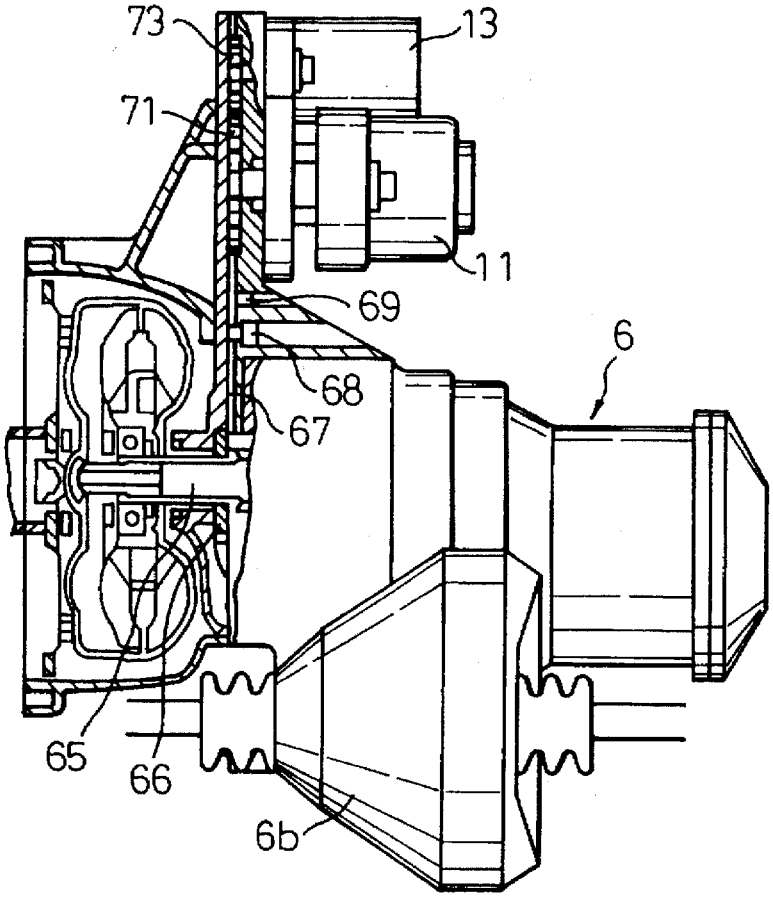
FIGS. 19A and 19B are partial cross-sectional side views of still another embodiment of the setup of FIGS. 17A and 17B.
Figure 19B:
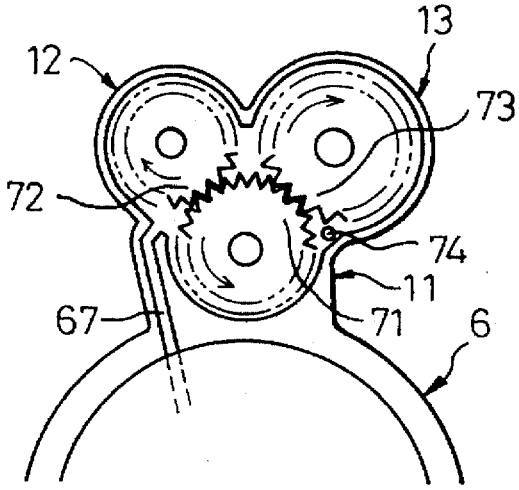

FIG. 17A to FIG. 19B show embodiments where the auxiliary machines are driven using the discharge oil pressure from an oil pump for the automatic transmission. That is, an automatic transmission oil pump 66 is provided at the input shaft 65 of the automatic transmission provided in the trans-axle 6. The oil passage 67 connecting to the discharge port of the oil pump 66 extends upward in the trans-axle 6. Inside the oil passage 67 are provided a flow control valve 68 and a pressure sensor 69. Note that FIGS. 17B, 18B, and 19B are side views of FIGS. 17A, 18A, and 19A.

In the embodiment shown in FIGS. 17A and 17B, the auxiliary machines, that is, the power steering oil pump 11, the alternator 12, and the air-conditioner compressor 13, are arranged along the top of the trans-axle 6. In this embodiment, the auxiliary machines 11, 12, and 13 are each provided with hydraulic motors. An oil passage 67 is connected to the hydraulic motors 70. Accordingly, when the engine is started and the automatic transmission oil pump 66 is activated, the hydraulic motor 70 is driven to rotate by the discharge oil pressure from the oil pump 66 and thereby the auxiliary machines 11, 12, and 13 are driven.

In the embodiment shown in FIGS. 18A and 18B, one auxiliary machine, that is, the oil pump 11, is provided with a hydraulic motor 70. The other auxiliary machines 12 and 13 are driven by the pulley 29 of the oil pump 11 through a chain or belt 30. In this case, instead of driving the pulleys 31 and 32 of the auxiliary machines 12 and 13 through the chain or belt 30, the auxiliary machines 12 and 13 may be driven through intermeshing gears.

In the embodiment shown in FIGS. 19A and 19B, a gear 71 is attached to the shaft of the oil pump 11, a gear 72 engaging with the gearwheel 71 is attached to the shaft of the alternator 12, and a gear 73 engaging with the gear 71 is attached to the shaft of the compressor 13. These gears 71, 72, and 73 form a hydraulic motor. That is, the oil supplied from the oil passage 67 flows around the gears 71 and 72 in the arrow direction to cause the gears 71 and 72 to turn in the arrow direction. The oil flowing out from around the gear 72 flows around the gear 73 in the arrow direction to cause the gear 73 to turn in the arrow direction. Next, the oil is returned from the oil discharge port 74 to the inside of the trans-axle 6.

Figure 20:
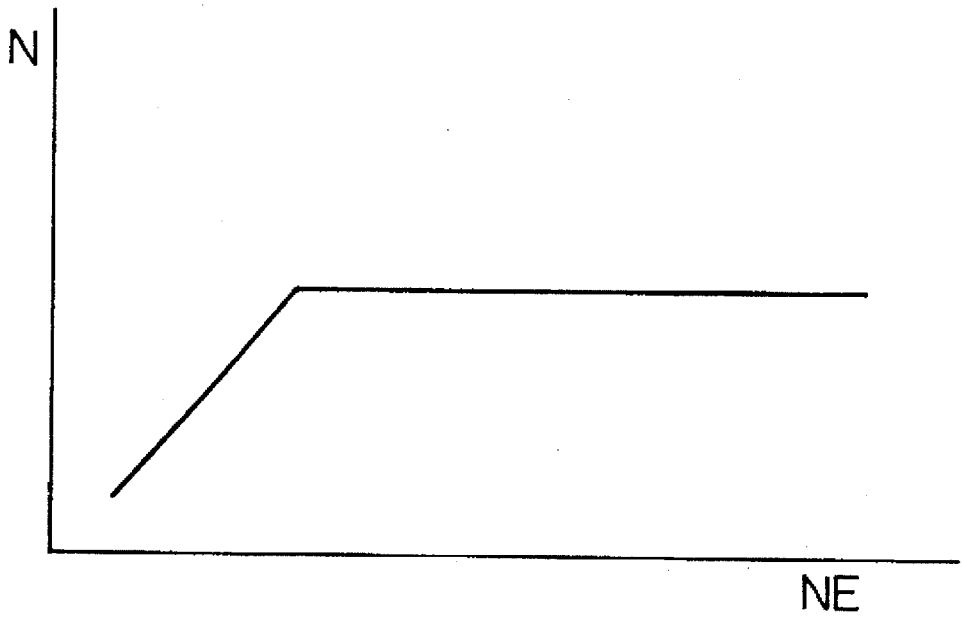
FIG. 20 is a view of the relationship between the engine rotational speed and the rotational speed of the auxiliary machines.

Further, the auxiliary machines 11, 12, and 13 shown from FIG. 17A to FIG. 19B are formed so that they can rotate sufficiently at a high speed even when the engine rotational speed is low, that is, even when the discharge oil pressure of the oil pump 66 for the automatic transmission is low. Accordingly, when the engine rotational speed rises and the discharge oil pressure of the oil pump 66 rises, the auxiliary machines 11, 12, and 13 are made to rotate at a higher than necessary speed. Accordingly, in this embodiment of the invention, as shown by the solid line in FIG. 20, when the engine rotational speed NE becomes more than a certain value, the flow control valve 68 is controlled based on output signals of the pressure sensor 69 so that the rotational speeds of the auxiliary machines 11, 12, and 13 become substantially constant. That is, when the engine rotational speed NE increases, the rotational speeds of the auxiliary machines 11, 12 and 13 are suppressed. By doing this, it is possible to improve the durability of the auxiliary machines 11, 12, and 13. Further, it is possible to use the output signals of the pressure sensor 69 to detect faults in the oil pump 66 and the auxiliary machines 11, 12, and 13.

Figure 21:
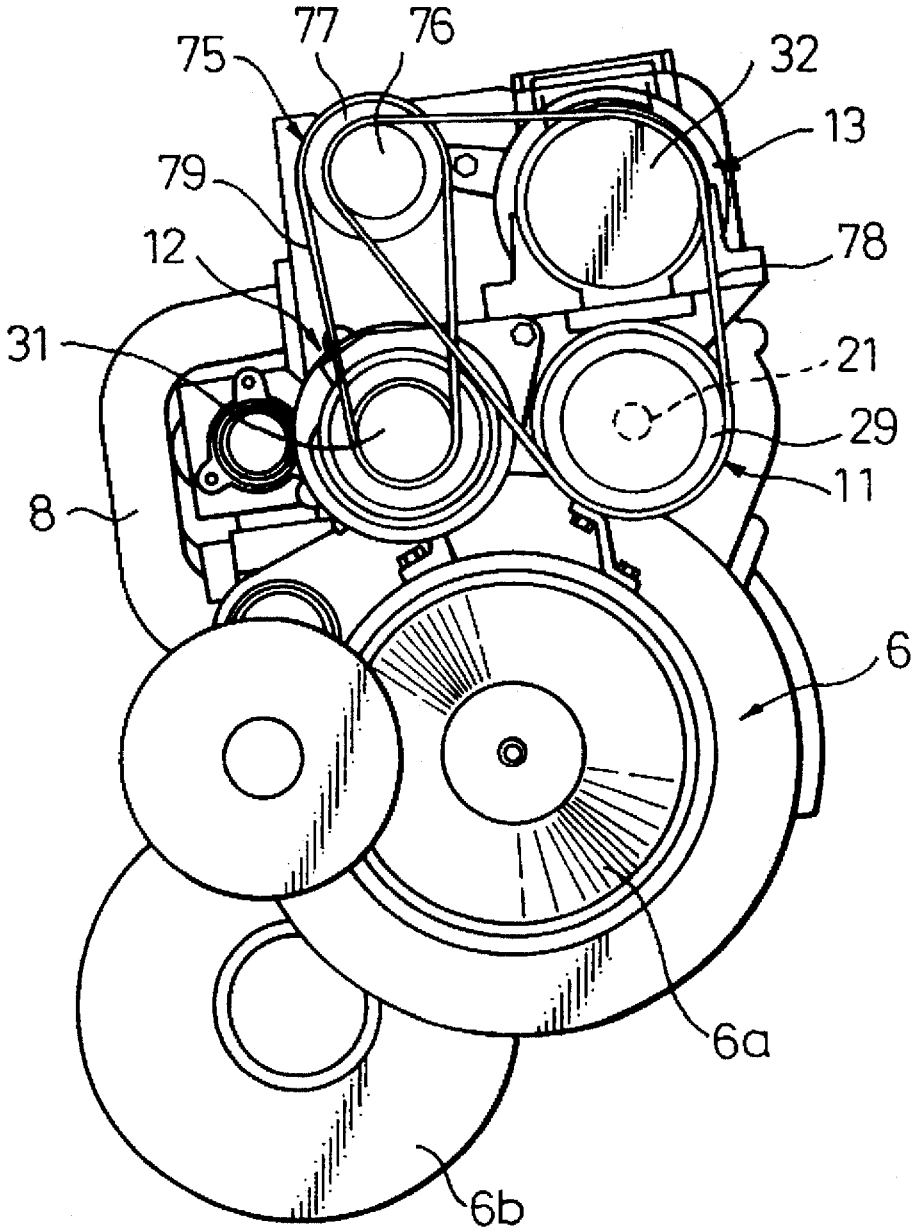
FIG. 21 is a side view of the engine body showing another embodiment of the invention.

The embodiment shown in FIG. 21 shows the case of provision of another auxiliary machine in addition to the three auxiliary machines, that is, the oil pump 11, the alternator 12, and the compressor 13, that is, an oil pump 75 for a hydraulically driven cooling fan. As shown in FIG. 21, in this embodiment as well, all of the auxiliary machines 11, 12, 13, and 75 are arranged in the space above the trans-axle 6. Further, in this embodiment, a small diameter pulley 76 and a large diameter pulley 77 are attached to the shaft of the oil pump 75. The small diameter pulley 76 of the oil pump 75 and the pulley 32 of the compressor 13 are driven by the pulley 29 of the oil pump 11 through a chain or belt 78, while the pulley 31 of the alternator 12 is driven by the large diameter pulley 77 of the oil pump 75 through a chain or belt 79.

Among the auxiliary machines 11, 12, 13, and 75 shown in FIG. 21, the alternator 12 has the worst fluctuations in load. Accordingly, the fluctuations in load of the alternator 12 have a considerable impact on the rotation of the intermediate shaft 21. In this case, rotational vibration occurs in the intermediate shaft 21, this becomes a cause behind rotational fluctuation of the engine. Therefore, in the embodiment shown in FIG. 21, the alternator 12 is made to be driven indirectly through the pulleys 76 and 77 of the oil pump 75, that is, through the two chains or belts 78 and 79. If connecting the pulley 29 of the oil pump 11 and the pulley 31 of the alternator 12 through the two chains or belts 78 and 79 in this way, the fluctuations in the load of the alternator 12 will no longer have much of an effect on the rotation of the intermediate shaft 21. Further, by using the two chains or belts 78 and 79, it is possible to secure a high speed-increasing ratio with respect to the alternator 12 in the limited space.

Figure 22A:
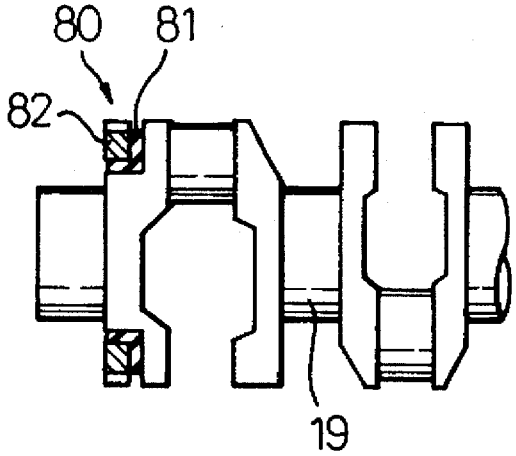
FIGS. 22A and 22B are views showing parts of a crankshaft.
Figure 22B:
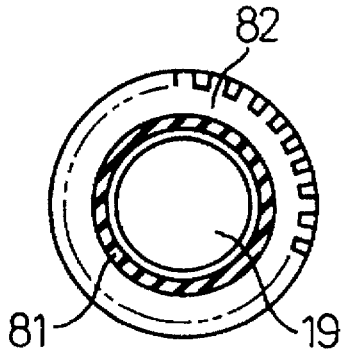
Figure 23A:
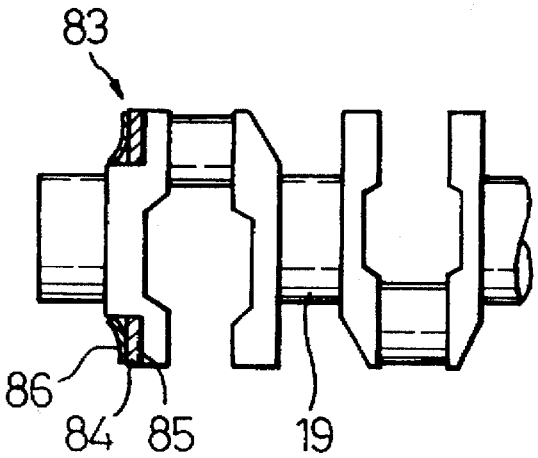
FIGS. 23A and 23B are views showing parts of a crankshaft.
Figure 23B:
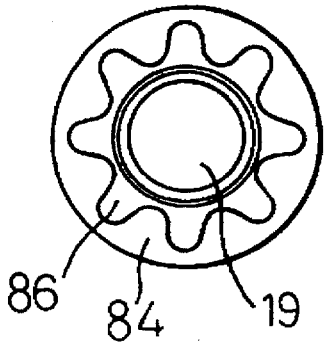

FIGS. 22*a* to FIG. 23B show the crankshaft 19 portion on the opposite side of the trans-axle 6 shown in FIG. 3. If a trans-axle 6 is provided, a large rotational mass is attached to the end of the crankshaft 19 at the trans-axle 6 side and as a result a large torsional vibration or bending vibration occurs at the crankshaft 19. To suppress this torsional vibration or bending vibration of the crankshaft 19, it is preferable to provide a dynamic damper at the end of the crankshaft at the opposite side of the trans-axle 6. FIGS. 22A to FIG. 23B show examples of the dynamic damper. Note that FIG. 22B and FIG. 23B show side views of FIG. 22A and FIG. 23A.

In the embodiment shown in FIGS. 22*a* and 22B, the dynamic damper 80 is comprised of an elastic body 81 and a geared weight 82 affixed on this elastic body 81. When vibration occurs in this crankshaft 19, the weight 82 rocks relative to the crankshaft 19 in a direction canceling out this vibration, whereby the vibration of the crankshaft 19 is attenuated. Further, in this embodiment, there is the advantage that the teeth of the weight 82 can be used to detect the rotational speed of the crankshaft 19.

In the embodiment shown in FIGS. 23A and 23B, the friction damper 83 is comprised of a ring-like weight 84, a friction member 85, and a spring holding member 86 for elastically supporting the weight 84. In this embodiment as well, when the crankshaft 19 vibrates, the weight 84 rocks relative to it in a direction canceling out the vibration of the crankshaft 19, whereby the vibration of the crankshaft 19 can be attenuated. Note that in this embodiment, the friction member 85 can be omitted.

Figure 24:
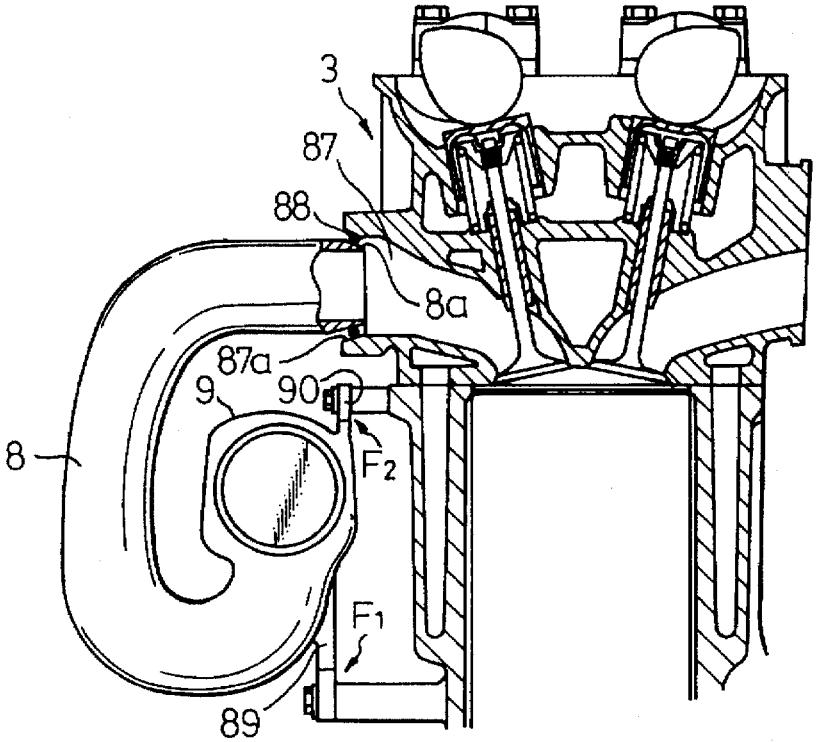
FIG. 24 is a side cross-sectional view of an engine body.

FIG. 24 shows the support structure of the intake pipes 8 and the surge tank 9. The intake ports 87 formed in the engine body 3 open toward the front of the direction of advance of the motor vehicle. The openings 87*a* of the intake ports 87 are formed from conical faces flaring outward. On the other hand the front ends 8*a* of the intake pipes 8 are also formed from conical faces tapering toward the intake ports 87. O-rings 88 are inserted between the openings 87*a* of the intake ports 87 and the front ends 8*a* of the intake pipes 8. On the other hand, stays 89 and 90 project from the intake pipes 8 or the surge tank 9. The front ends of these stays 89 and 90 are affixed to the engine body 3.

When the motor vehicle is involved in a collision and a pressing force acts on the intake pipes 8, the front ends 8*a* of the intake pipes 8 will be crushed and will be pushed deep into the intake ports 87. That is, the intake pipes 8 are constructed so that they easily move to the rear. Accordingly when the motor vehicle is involved in a collision, it is possible to improve the ability of the vehicle body to absorb the energy of the collision. Further, when a pressing force acts on the intake pipes 8, the intermediate portions of the stays 89 and 90 shown by $F_1$ and $F_2$ break and therefore the intake pipes 8 and the surge tank 9 can easily move further to the rear. Note that the intake pipes 8 and the surge tank 9 are preferably formed from aluminum alloys or plastics not high in rigidity.

Figure 25:
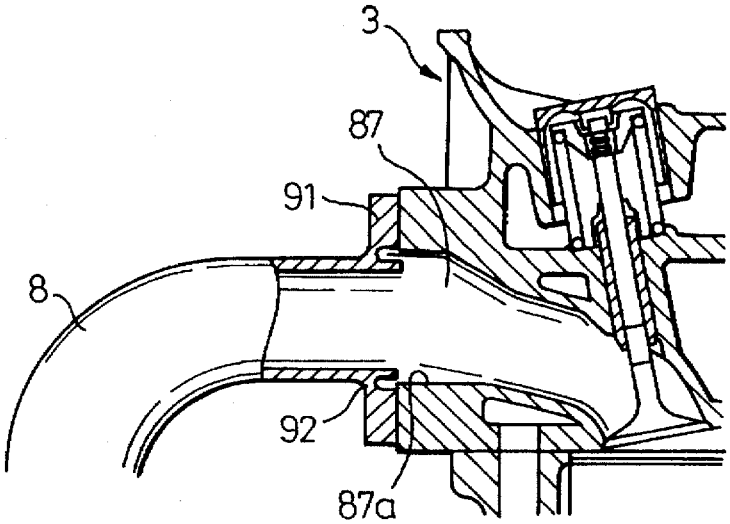
FIG. 25 is a side cross-sectional view of the engine body showing another embodiment of the setup of FIG. 24.

In the embodiment shown in FIG. 25, the openings 87*a* of the intake ports 87 are formed to have an inside diameter greater than the outside diameters of the intake pipes 8. Further, constricted portions 92 are formed between the flange portions 91 mounting the intake pipes 8 to the engine body 3 and the outer circumferences of the intake pipes 8. Accordingly, in this embodiment, when the motor vehicle is involved in a collision and a pressing force acts on the intake pipes 8, the constricted portions 92 will break and the intake pipes 8 will be pushed deep into the intake ports 87.

While the invention has been described by reference to specific embodiments chosen for purposes of illustration, it should be apparent that numerous modifications could be made thereto by those skilled in the art without departing from the basic concept and scope of the invention.

We claim:

1. An engine for use in a motor vehicle, comprising:

an engine body extending from a first end to a second end along a lateral axis, including:

(a) a plurality of cylinders each having at least one intake valve and at least one exhaust valve, (b) a crankshaft, (c) an intermediate shaft driven by the crankshaft and arranged in parallel to the crankshaft at a position which is laterally remote from a plane including axes of the cylinders, and (d) a camshaft driven by said intermediate shaft to drive at least one of the intake valve and the exhaust valve;

a trans-axle attached to and extending from the first end of the engine body, wherein a forward-most point on the surface of the trans-axle is included in a forward vertical plane and a rearward-most point on the surface of the trans-axle is included in a rear vertical plane; and at least one auxiliary machine arranged above the trans-axle and driven by said intermediate shaft, wherein the at least one auxiliary machine is located at the first end of the engine body between the forward and rear vertical planes.

2. An engine according to claim 1, wherein other additional auxiliary machines are arranged above the trans-axle in addition to that auxiliary machine and wherein at least part of those additional auxiliary machines are driven by the intermediate shaft through a belt or chain.

3. An engine according to claim 2, wherein an alternator is driven by one of the additional auxiliary machines through a belt or chain.

4. An engine according to claim 1, wherein at least two auxiliary machines are arranged above the trans-axle separated from each other in the vertical direction.

5. An engine according to claim 1, wherein a plurality of auxiliary machines are arranged above the trans-axle and the center axes of the auxiliary machines are offset from each other in the vertical direction.

6. An engine for use in a motor vehicle, comprising:

a plurality of cylinders each having at least one intake valve and at least one exhaust valve;

a crankshaft;

an intermediate shaft having a first end and s second end, driven by the crankshaft and arranged in parallel to the crankshaft at a position which is laterally remote from a plane including axes of the cylinders:

a camshaft driven by said intermediate shaft to drive at least one of the intake valve and the exhaust valve;

a trans-axle attached to one of the longitudinal ends of the engine:

at least one auxiliary machine arranged above the trans-axle and driven by said intermediate shaft, said auxiliary machine being connected to the first end of said intermediate shaft; and a water pump, said water pump being connected to the second end of the intermediate shaft.

7. An engine according to claim 6, wherein the auxiliary machine connected to the first end of the intermediate shaft is a pump for the power steering system, and heat exchange means is provided for exchanging heat between the water pump and the power steering pump.

8. An engine for use in a motor vehicle, comprising:

a plurality of cylinders each having at least one intake valve and at least one exhaust valve:

a crankshaft:

an intermediate shaft driven by the crankshaft and arranged in parallel to the crankshaft at a position which is laterally remote from a plane including axes of the cylinders;

a camshaft driven by said intermediate shaft to drive at least one of the intake valve and the exhaust valve;

a trans-axle attached to one of the longitudinal ends of the engine; and at least one auxiliary machine arranged above the trans-axle and driven by said intermediate shaft, wherein provision is made, between the auxiliary machine and the intermediate shaft, of torque limiting means for limiting the transmission of torque from the intermediate shaft to the auxiliary machine when the load of the auxiliary machine excessively increases.

9. An engine according to claim 1, wherein the engine is arranged in an engine compartment at the front of a motor vehicle so as to extend in the lateral direction with respect to the direction of advance of the vehicle and wherein intake pipes and a surge tank are arranged in front of the engine with respect to the direction of advance of the vehicle.

10. An engine for use in motor vehicle, comprising:

a plurality of cylinders each having at least one intake valve and at least one exhaust valve;

a crankshaft;

an intermediate shaft driven by the crankshaft and arranged in parallel to the crankshaft at a position which is laterally remote from a plane including axes of the cylinders;

a camshaft driven by said intermediate shaft to drive at least one of the intake valve and the exhaust valve;

a trans-axle attached to one of the longitudinal ends of the engine;

at least one auxiliary machine arranged above the trans-axle and driven by said intermediate shaft;

a plurality of intake pipes;

a surge tank, said intake pipes and surge tank arranged in front of the engine with respect to the direction of advance of the engine, wherein the engine is arranged in an engine compartment at the front of a motor vehicle so as to extend in the lateral direction with respect to the direction of advance of the vehicle, and wherein intake ports open on the engine in the front with respect to the direction of advance of the vehicle and are with the intake ports so that, at the time of a collision, the ends of the intake pipes can enter into the intake ports.

* * * * *